United States Patent [19]

Egusa et al.

[11] Patent Number: 4,592,172

[45] Date of Patent: Jun. 3, 1986

[54] METHOD OF MACHINING TAPERED ROLLER BEARING INNER RINGS

[75] Inventors: Tomoyoshi Egusa, Iwata; Yutaka Yamauchi, Ogasa, both of Japan

[73] Assignee: NTN Toyo Bearing Co., Ltd., Osaka, Japan

[21] Appl. No.: 414,325

[22] PCT Filed: Dec. 24, 1981

[86] PCT No.: PCT/JP81/00407

§ 371 Date: Aug. 9, 1982

§ 102(e) Date: Aug. 9, 1982

[87] PCT Pub. No.: WO83/01404

PCT Pub. Date: Apr. 28, 1983

[30] Foreign Application Priority Data

Oct. 24, 1981 [JP] Japan ..... 56-170358

[51] Int. Cl.[4] ..... B24B 49/04

[52] U.S. Cl. ..... 51/291; 51/3

[58] Field of Search ..... 51/291, 5 D, 326, 327, 51/290, 289 R, 165.83, 105 SP, 165 R

[56] References Cited

U.S. PATENT DOCUMENTS

| | | | |
|---|---|---|---|
| 2,660,006 | 11/1953 | Hegeman | 51/5 D |
| 2,807,916 | 10/1957 | Squire et al. | 51/88 |
| 3,145,507 | 8/1964 | Price et al. | 51/105 SP |
| 3,526,058 | 9/1970 | Price | 51/5 D |
| 4,179,854 | 12/1979 | Munekata et al. | 51/105 SP |
| 4,222,203 | 9/1980 | Wolff et al. | 51/291 |
| 4,363,196 | 12/1982 | Uhtenwoldt | 51/291 |

FOREIGN PATENT DOCUMENTS

| | | | |
|---|---|---|---|
| 0001660 | 1/1982 | Japan | 51/165 R |

*Primary Examiner*—Frederick R. Schmidt
*Assistant Examiner*—Robert A. Rose
*Attorney, Agent, or Firm*—Armstrong, Nikaido, Marmelstein & Kubovcik

[57] ABSTRACT

A method of machining tapered roller bearing inner rings, wherein after the inner ring raceway groove 14 has been finish-ground, the inner ring small end face 13 and cone back face rib surface 12 are simultaneously finish-ground. In the manufacture of double row tapered roller bearings, in order to ensure that the assembly clearance which is produced during assembly of double row tapered roller bearings is always maintained constant, the method is intended to finish the raceway groove diameter to a predetermined dimension on the basis of the small end face 13, even if there is a variation in the diameter of the raceway groove 14 of each tapered roller bearing. Thus, the method comprises converting any deviation of the raceway groove diameter from a target dimension into a deviation in the inner ring axial direction, feeding the converted value back to an in-process control gauge 30 for controlling grinding operation, and simultaneously grinding the small end face 13 and cone back face rib surface 12 of the inner ring 10 by an end face grinding stone 42 and a rib grinding stone 41 integrally connected with the former, under the control of the gauge.

4 Claims, 6 Drawing Figures

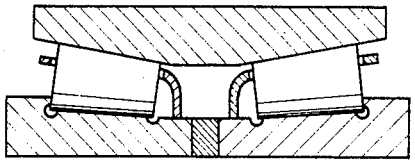
Fig. 1.
Fig. 3.
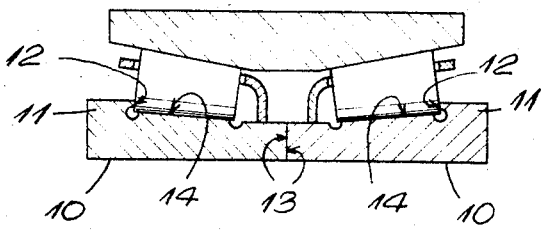
Fig. 2.
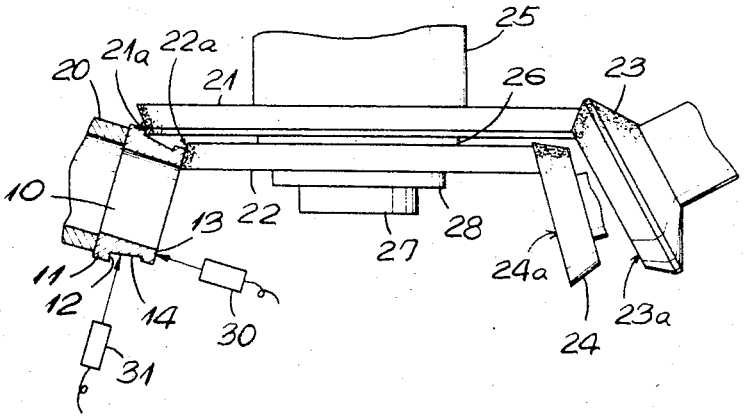

METHOD OF MACHINING TAPERED ROLLER BEARING INNER RINGS

This invention relates to a method of machining the inner rings of tapered roller bearings. More particularly, it relates to a method of machining the inner rings of double row tapered roller bearings or tapered roller bearings used in a double row, such as back-to-back duplex tapered roller bearings, and particularly to a method of machining tapered roller bearing inner rings in such a manner as to ensure that the dimension from the outer ring back face (small end face) to the inner ring front face (small end face), i.e., the plane difference, and the bearing assembly clearance (axial clearance) due to that plane difference are constant.

This assembly clearance refers to such a dimension that when two inner ring assemblies (comprising an inner ring, a retainer, and rollers) are combined for manufacture (assembly), e.g., of a double row tapered roller bearing and the front faces of the inner rings are butted against each other by a predetermined force, the outer ring is allowed to move axially under a predetermined measuring load. The assembly clearance, when bearings are assembled into a machine (e.g., on automobile axles), determines the running clearance and hence it is closely related to seizure, premature peeling, etc., greatly influencing the bearing life; thus it is one of the important conditions for bearing assembly.

Generally, the assembly clearance (axial clearance) of this type of bearing is determined by the plane difference of the bearing assembly. Of the dimensions of the various surfaces of the inner ring, those which influence the plane difference are the raceway groove diameter of the inner ring (the smaller the diameter, the smaller the plane difference; in other words, as viewed from the outer ring back face, the inner ring front face is positioned further onwards), the cone back face rib width or, briefly, rib dimension (the smaller the dimension, the smaller the plane difference), and the width (the smaller the width, the greater the plane difference: in other words, as viewed from the outer ring back face, the inner ring front face is positioned further backwards).

Conventionally, this type of bearing inner ring is machined in the order of width surfaces—raceway groove—cone back face rib surface. However, since each is machined according to its independent target point, the final finish dimension in each surface has an independent variation. As a result, despite the fact that each surface has been finished within the limits of its predetermined tolerance, it has been impossible to keep the bearing assembly clearance (axial clearance) under strict control.

This will now be described in more detail with reference to the finish dimension of the rolling groove.

If the plane difference from the outer ring back face to the inner ring front face with the raceway groove machined to a finish dimension based on the inner ring front face (in the case of a double row tapered roller bearing, the dimension from the outer ring width center to the front face of each inner ring) can be maintained constant, the tolerance can be strictly controlled and assembly can be performed without using a spacer for filling the axial clearance of the bearing assembly. However, the conventional method has been by attractively holding the finish-ground inner ring back face (large end face) of the bearing inner ring on the backing plate of a grinding machine, and grinding the raceway groove by a grinding stone by rotating the backing plate and inner ring while measuring the raceway groove diameter by an in-process control gauge (which controls grinding operation) positioned a predetermined distance away from the backing plate. Since this is based on the measurement of the raceway groove diameter at that fixed position spaced away from the inner ring back face, it follows that the raceway groove is machined on the basis of the inner ring back face. When viewed from the inner ring front face providing a basis for the plane difference dimension, the position at which the rolling groove is measured differs for each workpiece and so does the measured dimension because of a variation (which is within the limits of the predetermined tolerance) in the width of the inner ring.

Consequently, the conventional practice has, in assembly operation, been to place a spacer of predetermined thickness between the opposed front faces of two inner rings so as to absorb the dimensional error to provide a predetermined axial clearance (FIG. 1). Further, where two tapered roller bearings are assembled in back-to-back relation, likewise a spacer of predetermined thickness is interposed. Such practice, therefore, is required to prepare a number of spacers of different thicknesses in advance and a suitable spacer must be selected for each assembly of a bearing in accordance with the actual inner ring width, thus greatly detracting from operation capability (bearing assembling efficiency) and interchangeability (for example, a mating inner ring is limited).

The present invention is intended to eliminate the conventional problems described above and provide a method of machining the inner rings of tapered roller bearings in such a manner that the plane difference and the bearing assembly clearance depending thereon are maintained constant.

To this end, the method of this invention comprises the steps of grinding the raceway groove on the basis of the back face of an inner ring whose opposite end faces, i.e., the front face and back face have been ground by the usual grinding method in the preprocessing step, and simultaneously grinding the front face and cone back face rib surface by an end face grinding stone and a rib grinding stone which are connected together. According to the method of the invention, the finish-ground inner ring raceway groove is measured in advance; the deviation of the raceway groove finish dimension from a target dimension is converted into a deviation in the inner ring axial direction; the converted value is fed back to an in-process control gauge; and controlling the grinding operation is controlled by this gauge. Therefore, in this invention, even if there is a variation in the finish width in the preprocessing step and even if this variation results in a variation in the raceway groove diameter, the rolling groove diameter can be finished based on the front face to a predetermined value without being-influenced by such variations, ensuring that the axial clearance produced when the inner ring is combined with the outer ring is constant. Thus, in the case of assembly of double row tapered roller bearings or of bearings in back-to-back double row relation, such assembly can be performed without the need of adjusting the axial clearance and with no spacer or a single kind of spacers used, thus improving operation capability for assembling bearings and making it possible to strictly set the axial clearance (preload) when this bearing is incorporated in a machine (e.g., on an automobile axle). Further, in the present invention, since the finish width is feedback-controlled on the basis of the raceway groove diameter having less variation in the finish width, the amount of feedback can be minimized and control can be performed easily yet accurately. Further, in the present invention, since the dimension from the front face to the cone back face rib surface can be always maintained constant in grinding, the dimension from the front face to the cone back face rib surface can be simultaneously finished to the predetermined dimension (value with the variation in the rolling groove diameter taken into consideration) by simply feeding the axial length value corresponding to the deviation of the measured raceway groove diameter from the reference value back to an in-process control gauge contacted with either the cone back face rib surface or the front face.

Further, in this invention, when the inner ring front face and cone back face rib surface of a bearing inner ring having undergone raceway groove grinding on the basis of the inner ring back face are simultaneously ground by the end face grinding stone and the rib grinding stone connected together, the raceway groove diameter is measured in advance and if the cone back face rib dimension measured before machining by the in-process control gauge is outside the range of upper and lower limits of preset machining allowance with respect to the machining allowance for the cone back face rib surface necessary to ensure that the plane difference calculated on the basis of the measured value of the raceway groove diameter taken in advance has a predetermined dimension, the corresponding bearing inner ring is off-lined as an NG article before machining. Therefore, in this invention, if the cone back face rib surface machining allowance is inside the predetermined range, the front face and cone back face rib surface are simultaneously ground by the end face grinding stone and rib grinding stone connected together, and if the cone back face rib surface machining allowance is outside the range of predetermined upper and lower limits of machining allowance, the corresponding bearing inner ring is off-lined as an NG article, thereby preventing the skin of the inner ring cone back face rib surface from being left uncut or abnormal scaling-off from taking place in the rib grinding stone.

These and other objects and features of this invention will become more apparent from the following description to be given with reference to the accompanying drawings, in which:

FIG. 1 is a sectional view of a conventional double row tapered roller bearing using a spacer;

FIG. 2 is a schematic view for an explanation of a machining method according to an embodiment of this invention;

FIG. 3 is a sectional view of a double row tapered roller bearing assembled with no spacer and including an inner ring machined by the machining method of this invention;

Embodiments of the invention will now be described with reference to the drawing. In addition, throughout the figures like reference numerals indicate like parts or portions.

Figure 4:
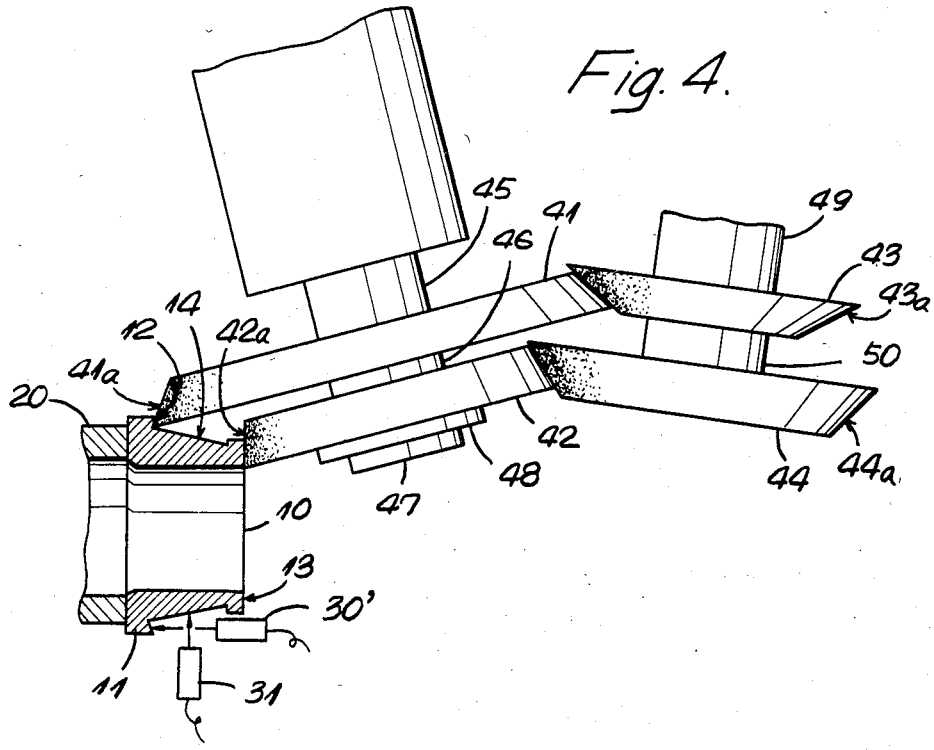
FIG. 4 is a schematic view for an explanation of another embodiment of a machining method according to this invention.

In FIG. 2, the numeral 10 denotes a tapered roller bearing inner ring attractively held on the backing plate 20 of a grinding machine; 21 denotes a rib grinding stone for grinding the rib surface 12 of the cone back face rib 11 of the inner ring 10; 22 denotes an end face grinding stone for grinding the front face, i.e., small end face 13 of the inner ring 10; 23 denotes a rotary dresser for the rib grinding stone; and 24 denotes a rotary dresser for the end face grinding stone. The rib grinding stone 21 and end face grinding stone 22 are concentrically arranged on a grinding stone spindle 25 through a grinding stone spacer 26 and in constant diameter dimensional relation and fixed by a flange nut 27 and adapted to grind the cone back face rib surface 12 and front face 13 of the inner ring 10 by their outer peripheral surfaces **21*a* and 22*a*. The numeral 28 denotes a grinding stone flange. The rotary dresser 23 for the rib grinding stone has the angle of its front end face 23*a* adjusted and is fixed to a dress compensation slide (not shown), while the rotary dresser 24 for the end face grinding stone is arranged so that its front end face 24*a* is revolvable in a horizontal plane with respect to the rotary dresser 23 for the rib grinding stone, the dresser 24 having a dress compensation slide (not shown). The numeral 30 denotes a first measuring instrument for in-process control attached to the fixed block (not shown) of the grinding machine and adapted to be brought into contact with the front face 13 of the inner ring 10 for measuring the width dimension from the end face of the backing plate 20 to the front face 13 of the inner ring 10; and 31 denotes a second measuring instrument for measuring the raceway groove diameter of the inner ring 10 at a position spaced a fixed distance from the end face of the backing plate 20**.

The machining method of this invention in the above arrangement will now be described. The back face of the bearing inner ring 10 whose raceway groove 14 has been ground to a target dimension based on the back face, i.e., large end face without regard to the width of the workpiece by the usual grinding method in the preprocessing step is attractively held on the backing plate 20, and the first measuring instrument 30 is butted against the front face 13 of the inner ring 10 and the second measuring instrument 31 is butted against the raceway groove 14, so as to measure the width and raceway groove diameter of the inner ring 10. At this time, the deviation (machining error) of the raceway groove diameter measured by the second measuring instrument 31 from a reference raceway groove diameter (target dimension in engineering design) is calculated and this deviation value is converted into a deviation value in the inner ring axial direction, the converted value being fed back to the first measuring instrument. Subsequently, the cone back face rib surface 12 and front face 13 of the inner ring 10 are simultaneously ground by the rib grinding stone 23 and end face grinding stone 24 connected together in constant diameter dimensional relation, until the measured value provided by the zero-point calibrated first measuring instrument is equal to the predetermined inner ring width.

This manner of grinding results in the raceway groove diameter of the inner ring 10 being set in accordance with the inner ring width, so that the raceway groove diameter is maintained constant based on the front face 13 for each inner ring, enabling back-to-back bearing assembly to be made without any spacer, as shown in FIG. 3, or using a single kind of spacers, thus improving operation capability.

FIG. 4 is a schematic view showing how the cone back face rib surface and front face of a bearing inner ring are simultaneously ground by a method according to another embodiment of the invention.

In the same figure, 41 denotes a rib grinding stone for grinding the cone back face rib surface 12 of the inner ring 10; 42 denotes an end face grinding stone for grinding the front face 13 of the inner ring 10; 43 denotes a rotary dresser for the rib grinding stone; and 44 denotes a rotary dresser for the end face grinding stone. The rib grinding stone 41 and end face grinding stone 42 are coaxially arranged on a grinding stone spindle in constant diameter difference dimensional relation and through a grinding stone spacer 46 and fixed by a flange nut 47 and adapted to grind the cone back face rib surface 12 and front face 13 of the inner ring 10 by their outer peripheral surfaces 41*a* and 42*a*. The numeral 48 denotes a grinding stone flange. In addition, the rotary dresser 43 for the rib grinding stone and the rotary dresser 44 for the end face grinding stone are coaxially fixed on a dress spindle 49 through a spacer 50. The dress spindle 49 is fixed to a dress compensation slide (not shown) while forming an angle with the grinding stone spindle 45, and a positional adjustment is made so that the angle between the front end face 44*a* of the rotary dresser 44 for the end face grinding stone and the front end face 43*a* of the rotary dresser 43 for the rib grinding stone is equal to the angle between the cone back face rib surface 12 and front face 13 of the bearing inner ring 10. Indicated at 30' is a first measuring instrument for in-process control attached to the grinding machine and adapted to be brought into contact with the cone back face rib surface 12 of the inner ring 10 for measuring the rib dimension (axial width of the cone back face rib) from the end face of the backing plate 20 to the cone back face rib surface 12 of the inner ring 10. The second measuring instrument 31 is attached to the grinding machine as in the embodiment shown in FIG. 2, for measuring the diameter of the ground raceway groove of the inner ring 10.

Figure 5:
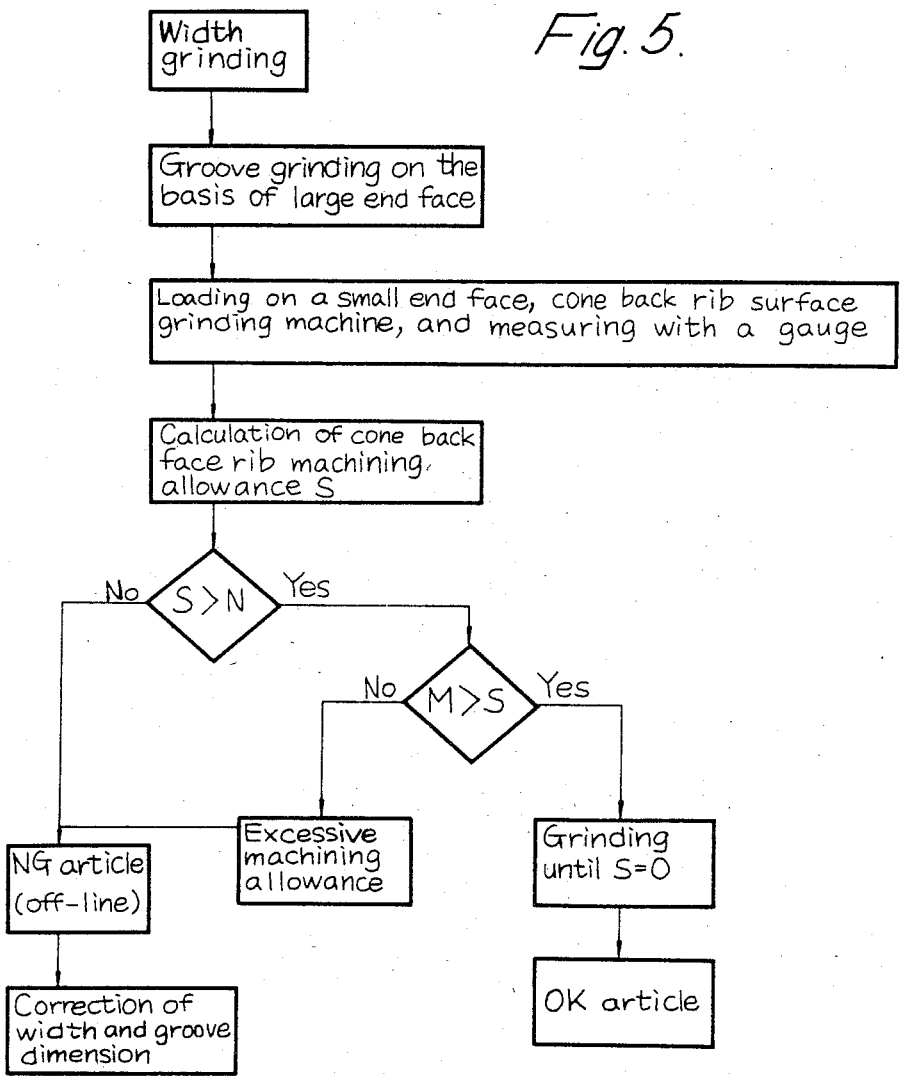
FIG. 5 is a flowchart of the procedure involved in the same embodiment.

The machining method, in the above arrangement, will now be described with reference to the flowchart shown in FIG. 5. The back face of the bearing inner ring 10 whose opposite end faces have been ground by the usual grinding method in the preprocessing step and whose raceway groove has been ground to a target dimension based on the back face is attractively held on the backing plate 20, and the first and second measuring instruments 30' and 31 are butted against the cone back face rib surface 12 and raceway groove 14 of the inner ring 10, respectively, for measuring the rib dimension and raceway groove diameter of the inner ring 10. At this time, the deviation (machining error) of the raceway groove diameter measured by the second measuring instrument 31 from the reference raceway groove diameter (target dimension in engineering design for securing a predetermined plane difference) is calculated, and this deviation value is converted into a deviation value in the inner ring axial direction (a deviation value converted into a plane difference dimension), the converted value being fed back to the first measuring instrument 30'. It is then calculated how much the cone back face rib surface 12 should be ground to secure the predetermined plane difference with the zero-point calibrated first measuring instrument 30', so as to find the machining allowance for the cone back face rib surface 12 of the inner ring 10. Of course, the grinding operation is controlled by the first measuring instrument 30'.

Whether or not this machining allowance S is larger than the lower limit N of preset machining allowance S is judged, and if it is found to be smaller than the lower limit N, the corresponding inner ring 10 is off-lined as an NG article. If it is found to be larger than the lower limit N, it is then judged whether or not the machining allowance S is smaller than the upper limit of preset machining allowance S, and if it is found to be larger than the upper limit M of machining allowance S, it is judged to be an excessive machining allowance and again the corresponding inner ring 10 is off-lined as NG article. If the machining allowance S is found to be within the predetermined range, the cone back face rib surface 12 and front face 13 of the inner ring 10 are simultaneously ground by the rib grinding stone 41 and end face grinding stone 42 connected together in constant diameter difference dimensional relation, until the machining allowance S is zero, while performing in-process control by the zero-point calibrated first measuring instrument 30' as in the embodiment shown in FIG. 2.

Grinding the cone back face rib surface 12 and front face 13 of the inner ring 10 in this manner results in the raceway groove diameter of the inner ring 10 being set in accordance with the inner ring width, so that the raceway groove diameter based on the inner ring front face 13 is maintained constant and hence the plane difference or axial clearance of the bearing assembly is maintained constant. Thus, in the case of back-to-back assembly, this can be performed with no spacer, as shown in FIG. 3, or a single kind of spacers used, thus improving operation capability.

Further, it is possible to prevent skin removing (unground surface) from taking place in the cone back face rib surface 12 or abnormal scaling-off from taking place in the rib grinding stone owing to excessive cut. Further, since the rib grinding stone rotary dresser and the end face grinding stone rotary dresser for dressing the rib grinding stone and end face grinding stone are coaxially supported on a single dress spindle, it is possible to prevent the distance between the rib grinding stone and the end face grinding stone from varying with the variation of conditions during dressing.

Figure 6:
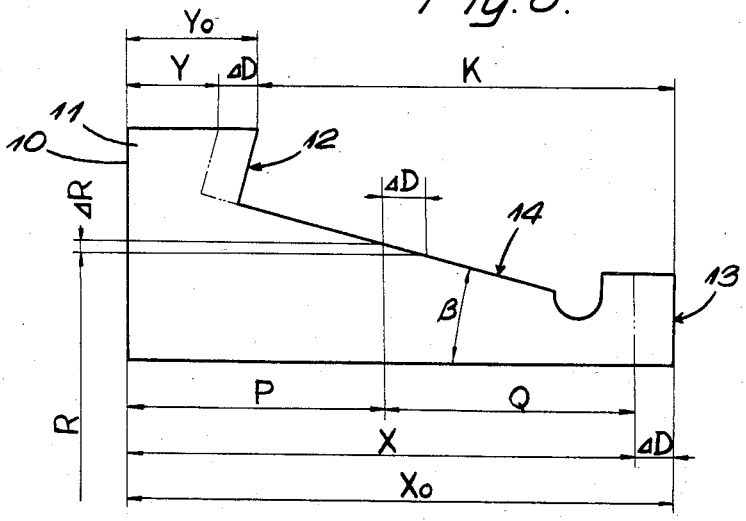
FIG. 6 is a schematic view showing the machining principle of this invention.

Stated in more detail, the machining method of the present invention, as shown in FIG. 6, simultaneously grinds the cone back face rib surface 12 and front face 13 of the inner ring 10, whose raceway groove has been finish-machined in the preprocessing step, using the in-process control gauge 30, 30' zero-point calibrated in accordance with the finished raceway groove diameter. Since the rib grinding stone 21, 41 and the end face grinding stone 22, 42 are connected together in constant diameter dimensional relation (the separation distance being constant), the distance K between the cone back face rib surface 12 and front face 13 of the ground inner ring 10 is always maintained constant. Thus, assuming that the raceway groove diameter at distance P from the back face of the inner ring 10 has been finished $\Delta R$ in terms of radius greater than the reference raceway groove diameter R. In order to make the raceway groove diameter at position Q from the inner ring front face equal to the reference raceway groove diameter R, the grinding of the inner ring front face must be terminated $\Delta D$ short.

This $\Delta D$ is expressed by the following equation: $(\Delta D/\Delta R) = \cot \beta \therefore \Delta D = \Delta R \cot \beta$. Therefore, in the case of the embodiment shown in FIG. 4, if the zero-point for the cone back face rib dimension measured by the first measuring instrument 30' is fed back $\Delta D$ short and the cone back face rib surface 12 is ground until the cone back face rib dimension is Yo, then it follows that the distance from the cone back face rib surface 12 to the inner ring front face 13 is finished to the reference dimension K and that at the same time the raceway groove diameter at the position of distance Q from the inner ring front face 13 is R. Therefore, there is no possibility of the dimensions of the portions 12, 13 and 14 of the inner ring being influenced by the width dimension including machining errors, and the plane difference for each inner ring can be made constant. As described, according to the method of the invention, if the raceway groove diameter at the position of distance P from the back face has been finished $\Delta R$ in terms of radius greater than the reference dimension R in engineering design, this inner ring 10 will be finished with a width Xo and a cone back face rib dimension Yo. In addition, X and Y represent base values in engineering design for the width and the rib dimension, respectively.

As many apparently widely different embodiments of this invention may be made without departing from the spirit and scope thereof, it is to be understood that the invention is not limited to the specific embodiments thereof except as defined in the appended claims.

What is claimed is:

1. A method of machining tapered roller bearing inner rings comprising the steps of:

grinding a raceway groove of said inner ring;

measuring a raceway groove diameter at a fixed axial distance away from a cone back face of said inner ring;

converting any deviation of said raceway groove diameter from a target dimension into a deviation in the inner ring axial direction;

feeding back said converted value to an in-process control gauge for controlling subsequent grinding of a front face and cone back face rib surface of said inner ring; and simultaneously grinding the front face and cone back face rib surface of the inner ring, respectively, by an end face grinding stone and a cone back face rib grinding stone which are connected together, the amount of stock removal by said grinding stones being determined by ceasing grinding in response to a stop signal supplied by said in-process control gauge when said target dimension is achieved.

2. A method as set forth in claim 1, wherein said in-process control gauge is applied to the front face of the inner ring to measure the width of the inner ring.

3. A method as set forth in claim 1, wherein said in-process control gauge is applied to the cone back face rib surface of the inner ring to measure the cone back face rib width.

4. A method as set forth in claim 3, wherein whether or not the machining allowance for the cone back face rib surface is within a preset range is judged by said in-process control gauge before the grinding of the cone back face rib surface, and if it is found to be within said range, the front face and cone back face rib surface of the inner ring are simultaneously ground, respectively, by the end face grinding stone and rib grinding stone connected together.

* * * * *